US007940015B2

(12) United States Patent
Chitta et al.

(10) Patent No.: US 7,940,015 B2
(45) **Date of Patent: *May 10, 2011**

(54) THERMAL PROTECTION FOR LAMP BALLASTS

(75) Inventors: Venkatesh Chitta, Center Valley, PA (US); Mark S. Taipale, Harleysville, PA (US); Jonathan Robert Quayle, Bethlehem, PA (US); Thomas R. Hinds, Bethlehem, PA (US)

(73) Assignee: Lutron Electronics Co., Inc., Coopersburg, PA (US)

( * ) Notice: Subject to any disclaimer, the term of this patent is extended or adjusted under 35 U.S.C. 154(b) by 0 days.

This patent is subject to a terminal disclaimer.

(21) Appl. No.: 12/714,972

(22) Filed: Mar. 1, 2010

(65) Prior Publication Data

US 2010/0171435 A1 Jul. 8, 2010

Related U.S. Application Data

(63) Continuation of application No. 11/489,145, filed on Jul. 18, 2006, now Pat. No. 7,675,250, which is a continuation-in-part of application No. 11/214,314, filed on Aug. 29, 2005, now Pat. No. 7,436,131, which is a continuation of application No. 10/706,677, filed on Nov. 12, 2003, now Pat. No. 6,982,528.

(51) Int. Cl.
*G05F 1/00* (2006.01)

(52) U.S. Cl. ..... 315/309; 315/307; 315/291; 315/360; 315/118; 315/209 R

(58) Field of Classification Search ..... 315/309, 315/307, 291, 297, 209 R, 219, 224, 225, 315/112, 117, 118, 149, 158, 360; 361/27, 37, 93.8, 103, 106
See application file for complete search history.

(56) References Cited

U.S. PATENT DOCUMENTS

| | | | | |
|---|---|---|---|---|
| 3,488,573 | A | 1/1970 | Cavigelli et al. | |
| 3,673,538 | A | 6/1972 | Faxon | |
| 4,064,448 | A | 12/1977 | Eatock | |
| 4,467,386 | A | 8/1984 | Wasson | |
| 4,580,088 | A | 4/1986 | Bloomer | |
| 4,675,777 | A | 6/1987 | Watrous | |
| 4,800,974 | A | 1/1989 | Wand et al. | |
| 5,079,409 | A | 1/1992 | Takada et al. | |
| 5,083,065 | A | 1/1992 | Sakata et al. | |
| 5,315,214 | A | 5/1994 | Lesea | |
| 5,869,969 | A | 2/1999 | Cividino et al. | |
| 6,137,240 | A | 10/2000 | Bogdan | |
| 6,140,777 | A * | 10/2000 | Wang et al. | 315/247 |
| 6,166,491 | A | 12/2000 | Tsuchiya et al. | |
| 6,198,234 | B1 | 3/2001 | Henry | |
| 6,313,586 | B1 | 11/2001 | Yamamoto et al. | |
| 6,359,266 | B2 | 3/2002 | Little et al. | |

(Continued)

FOREIGN PATENT DOCUMENTS

DE 19536142 A1 3/1997

(Continued)

*Primary Examiner* — Haissa Philogene
(74) *Attorney, Agent, or Firm* — Woodcock Washburn LLP

(57) ABSTRACT

The output current of a ballast is dynamically limited when an over-temperature condition is detected in the ballast according to one of (i) a step function or (ii) a combination of step and continuous functions, so as to reduce the temperature of the ballast while continuing to operate it.

17 Claims, 11 Drawing Sheets

U.S. PATENT DOCUMENTS

| | | | | |
|---|---|---|---|---|
| 6,452,344 | B1 | 9/2002 | MacAdam et al. | |
| 6,621,239 | B1 | 9/2003 | Belliveau | |
| 6,946,984 | B2 * | 9/2005 | Rubin et al. | 341/141 |
| 6,963,178 | B1 * | 11/2005 | Lev et al. | 315/307 |
| 6,965,502 | B2 | 11/2005 | Duffy et al. | |
| 6,982,528 | B2 | 1/2006 | Cottongim et al. | |
| 7,009,829 | B2 | 3/2006 | Lentz et al. | |
| 7,436,131 | B2 | 10/2008 | Cottingim et al. | |
| 7,619,539 | B2 * | 11/2009 | Veskovic et al. | 340/825.22 |
| 7,675,250 | B2 | 3/2010 | Chitta et al. | |
| 2002/0158861 | A1 | 10/2002 | Maksimovic et al. | |
| 2002/0171985 | A1 | 11/2002 | Duffy et al. | |
| 2003/0031037 | A1 | 2/2003 | Piaskowski | |
| 2005/0099142 | A1 | 5/2005 | Cottongim et al. | |
| 2005/0156534 | A1 | 7/2005 | Oh | |
| 2005/0225256 | A1 | 10/2005 | Scolaro et al. | |
| 2005/0280377 | A1 | 12/2005 | Cottongim et al. | |
| 2006/0017389 | A1 | 1/2006 | Noh | |
| 2009/0033248 | A1 | 2/2009 | Cottongim et al. | |

FOREIGN PATENT DOCUMENTS

| | | | |
|---|---|---|---|
| DE | 19805801 | A1 | 8/1999 |
| DE | 10013041 | A1 | 9/2001 |
| EP | 1047286 | B1 | 10/2000 |
| JP | 2002/233161 | | 8/2002 |

* cited by examiner

PRIOR ART
NON-DIMMING BALLAST

Prior Art
Dimming Ballast

THERMAL PROTECTION FOR LAMP BALLASTS

CROSS REFERENCE TO RELATED APPLICATIONS

This application is a continuation application of Ser. No. 11/489,145, filed Jul. 18, 2006, which is a continuation-in-part application of Ser. No. 11/214,314, filed Aug. 29, 2005, now U.S. Pat. No. 7,436,131, which is a continuation application of Ser. No. 10/706,677, filed Nov. 12, 2003, now U.S. Pat. No. 6,982,528, all of which are incorporated herein by reference in their entirety.

FIELD OF THE INVENTION

This invention relates to thermal protection for lamp ballasts. Specifically, this invention relates to a ballast having active thermal management and protection circuitry that allows the ballast to safely operate when a ballast over-temperature condition has been detected, allowing the ballast to safely continue to provide power to the lamp.

BACKGROUND OF THE INVENTION

Lamp ballasts are devices that convert standard line voltage and frequency to a voltage and frequency suitable for a specific lamp type. Usually, ballasts are one component of a lighting fixture that receives one or more fluorescent lamps. The lighting fixture may have more than one ballast.

Ballasts are generally designed to operate within a specified operating temperature. The maximum operating temperature of the ballast can be exceeded as the result of a number of factors, including improper matching of the ballast to the lamp(s), improper heat sinking, and inadequate ventilation of the lighting fixture. If an over-temperature condition is not remedied, then the ballast and/or lamp(s) may be damaged or destroyed.

Some prior art ballasts have circuitry that shuts down the ballast upon detecting an over-temperature condition. This is typically done by means of a thermal cut-out switch that senses the ballast temperature. When the switch detects an over-temperature condition, it shuts down the ballast by removing its supply voltage. If a normal ballast temperature is subsequently achieved, the switch may restore the supply voltage to the ballast. The result is lamp flickering and/or a prolonged loss of lighting. The flickering and loss of lighting can be annoying. In addition, the cause may not be apparent and might be mistaken for malfunctions in other electrical systems, such as the lighting control switches, circuit breakers, or even the wiring.

SUMMARY OF THE INVENTION

A lamp ballast has temperature sensing circuitry and control circuitry responsive to the temperature sensor that limits the output current provided by the ballast when an over-temperature condition has been detected. The control circuitry actively adjusts the output current as long as the over-temperature condition is detected so as to attempt to restore an acceptable operating temperature while continuing to operate the ballast (i.e., without shutting down the ballast). The output current is maintained at a reduced level until the sensed temperature returns to the acceptable temperature.

Various methods for adjusting the output current are disclosed. In one embodiment, the output current is linearly adjusted during an over-temperature condition. In another embodiment, the output current is adjusted in a step function during an over-temperature condition. In yet other embodiments, both linear and step function adjustments to output current are employed in differing combinations. In principle, the linear function may be replaced with any continuous decreasing function including linear and non-linear functions. Gradual, linear adjustment of the output current tends to provide a relatively imperceptible change in lighting intensity to a casual observer, whereas a stepwise adjustment may be used to create an obvious change so as to alert persons that a problem has been encountered and/or corrected.

The invention has particular application to (but is not limited to) dimming ballasts of the type that are responsive to a dimming control to dim fluorescent lamps connected to the ballast. Typically, adjustment of the dimming control alters the output current delivered by the ballast. This is carried out by altering the duty cycle, frequency or pulse width of switching signals delivered to a one or more switching transistors in the output circuit of the ballast. These switching transistors may also be referred to as output switches. An output switch is a switch, such as a transistor, whose duty cycle and/or switching frequency is varied to control the output current of the ballast. A tank in the ballast's output circuit receives the output of the switches to provide a generally sinusoidal (AC) output voltage and current to the lamp(s). The duty cycle, frequency or pulse width is controlled by a control circuit that is responsive to the output of a phase to DC converter that receives a phase controlled AC dimming signal provided by the dimming control. The output of the phase to DC converter is a DC signal having a magnitude that varies in accordance with a duty cycle value of the dimming signal. Usually, a pair of voltage clamps (high and low end clamps) is disposed in the phase to DC converter for the purpose of establishing high end and low end intensity levels. The low end clamp sets the minimum output current level of the ballast, while the high end clamp sets its maximum output current level.

According to one embodiment of the invention, a ballast temperature sensor is coupled to a foldback protection circuit that dynamically adjusts the high end clamping voltage in accordance with the sensed ballast temperature when the sensed ballast temperature exceeds a threshold. The amount by which the high end clamping voltage is adjusted depends upon the difference between the sensed ballast temperature and the threshold. According to another embodiment, the high and low end clamps need not be employed to implement the invention. Instead, the foldback protection circuit may communicate with a multiplier, that in turn communicates with the control circuit. In this embodiment, the control circuit is responsive to the output of the multiplier to adjust the duty cycle, pulse width or frequency of the switching signal.

The invention may also be employed in connection with a non-dimming ballast in accordance with the foregoing. Particularly, a ballast temperature sensor and foldback protection are provided as above described, and the foldback protection circuit communicates with the control circuit to alter the duty cycle, pulse width or frequency of the one or more switching signals when the ballast temperature exceeds the threshold.

In each of the embodiments, a temperature cutoff switch may also be employed to remove the supply voltage to shut down the ballast completely (as in the prior art) if the ballast temperature exceeds a maximum temperature threshold.

According to another embodiment of the present invention, a circuit for controlling output current from a ballast to a lamp comprises a temperature sensor and a programmable controller. The temperature sensor is thermally coupled to the ballast to provide a temperature signal having a magnitude indicative of ballast temperature, Tb. The programmable controller is operable to cause the ballast to enter a current limiting mode when the magnitude of the temperature signal indicates that Tb has exceeded a predetermined ballast temperature, T1. The programmable controller causes the output current to be responsive to the temperature signal according to one of (i) a step function or (ii) a combination of step and continuous functions, while continuing to operate the ballast.

In addition, the present invention provides a thermally protected ballast, which comprises a front end AC-to-DC converter, a back end DC-to-AC converter, a temperature sensor, and a programmable controller. The front end AC-to-DC converter receives a supply voltage, while the back end DC-to-AC converter is coupled to the front end AC-to-DC converter for providing output current to a load. The temperature sensor is adapted to provide a temperature signal having a magnitude indicative of a temperature of the ballast, Tb. The programmable controller is responsive to the temperature signal and operable to cause the DC-to-AC circuit to adjust the output current. The temperature signal causes the programmable controller to adjust the output current in response to a detected over-temperature condition, according to one of (i) a step function or (ii) a combination of step and linear functions, while continuing to operate the ballast.

The present invention further provides a method of controlling a ballast comprising the steps of: a) determining a temperature Tb of the ballast; b) comparing the temperature Tb to a first reference temperature T1; and c) controlling an output current provided by the ballast according to one of (i) a step function or (ii) a combination of a step and continuous functions, while continuing to operate the ballast, in accordance with the result of step (b).

Other features of the invention will be evident from the following detailed description of the preferred embodiments.

DETAILED DESCRIPTION OF THE PREFERRED EMBODIMENTS

Figure 1:
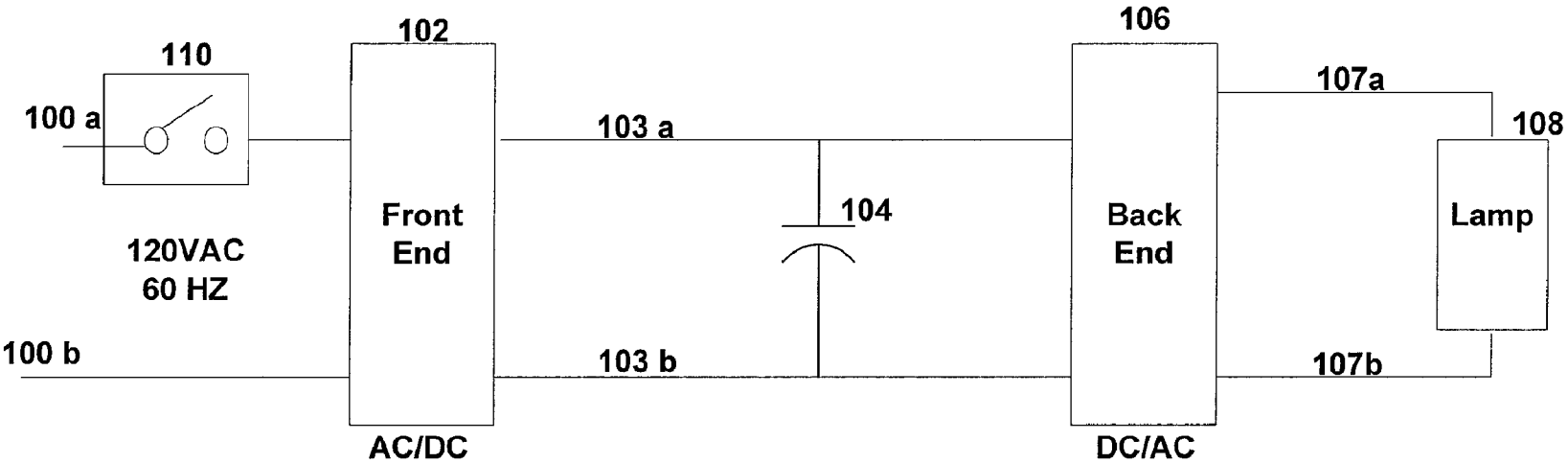
FIG. 1 is a functional block diagram of a prior art non-dimming ballast.
Figure 2:
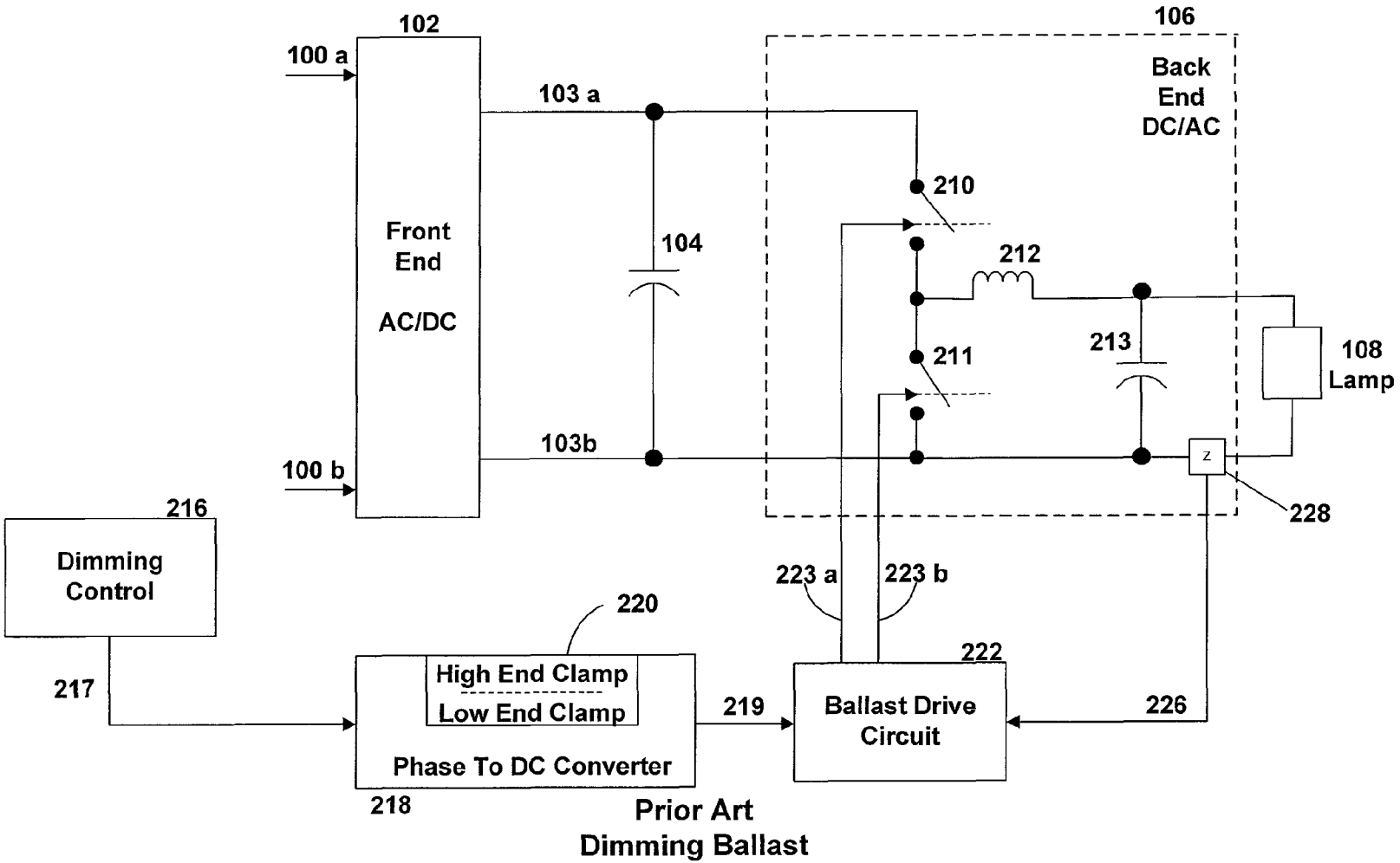
FIG. 2 is a functional block diagram of a prior art dimming ballast.

Turning now to the drawings, wherein like numerals represent like elements there is shown in FIGS. 1 and 2 functional block diagrams of typical prior art non-dimming and dimming ballasts, respectively. Referring to FIG. 1, a typical non-dimming ballast includes a front end AC to DC converter 102 that converts applied line voltage 100*a, b*, typically 120 volts AC, 60 Hz, to a higher voltage, typically 400 to 500 volts DC. Capacitor 104 stabilizes the high voltage output on 103*a, b* of AC to DC converter 102. The high voltage across capacitor 104 is presented to a back end DC to AC converter 106, which typically produces a 100 to 400 Volt AC output at 45 KHz to 80 KHz at terminals 107*a, b* to drive the load 108, typically one or more florescent lamps. Typically, the ballast includes a thermal cut-out switch 110. Upon detecting an over-temperature condition, the thermal cutout switch 110 removes the supply voltage at 100*a* to shut down the ballast. The supply voltage is restored if the switch detects that the ballast returns to a normal or acceptable temperature.

Figure 4:
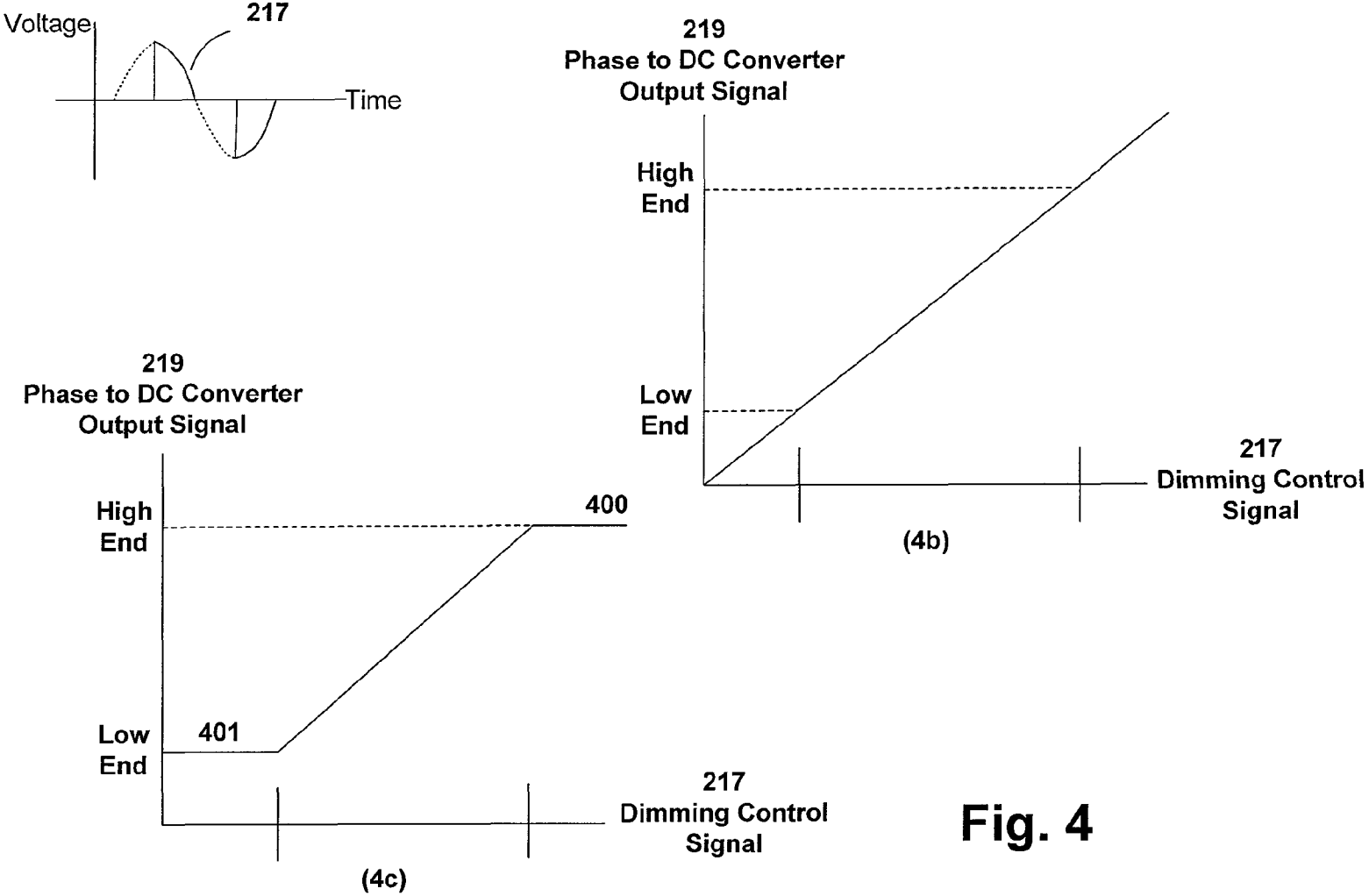
FIG. 4*a* graphically illustrates the phase controlled output of a typical dimming control.
FIG. 4*b* graphically illustrates the output of a typical phase to DC converter.
FIG. 4*c* graphically illustrates the effect of a high and low end clamp circuit on the output of a typical phase to DC converter.

The above description is applicable to FIG. 2, except that FIG. 2 shows additional details of the back end DC to AC converter 106, and includes circuitry 218, 220 and 222 that permits the ballast to respond to a dimming signal 217 from a dimming control 216. The dimming control 216 may be any phase controlled dimming device and may be wall mountable. An example of a commercially available dimming ballast of the type of FIG. 2 is model number FDB-T554-120-2, available from Lutron Electronics, Co., Inc., Coopersburg, Pa., the assignee of the present invention. As is known, the dimming signal is a phase controlled AC dimming signal, of the type shown in FIG. 4*a*, such that the duty cycle of the dimming signal and hence the RMS voltage of the dimming signal varies with adjustment of the dimming actuator. Dimming signal 217 drives a phase to DC converter 218 that converts the phase controlled dimming signal 217 to a DC voltage signal 219 having a magnitude that varies in accordance with a duty cycle value of the dimming signal, as graphically shown in FIG. 4*b*. It will be seen that the signal 219 generally linearly tracks the dimming signal 217. However, clamping circuit 220 modifies this generally linear relationship as described hereinbelow.

The signal 219 stimulates ballast drive circuit 222 to generate at least one switching control signal 223*a, b*. Note that the switching control signals 223*a, b* shown in FIG. 2 are typical of those in the art that drive output switches in an inverter function (DC to AC) in the back-end converter 106. An output switch is a switch whose duty cycle and/or switching frequency is varied to control the output current of the ballast. The switching control signals control the opening and closing of output switches 210, 211 coupled to a tank circuit 212, 213. Although FIG. 2 depicts a pair of switching control signals, 223*a, b*, an equivalent function that uses only one switching signal may be used. A current sense device 228 provides an output (load) current feedback signal 226 to the ballast drive circuit 222. The duty cycle, pulse width or frequency of the switching control signals is varied in accordance with the level of the signal 219 (subject to clamping by the circuit 220), and the feedback signal 226, to determine the output voltage and current delivered by the ballast.

High and low end clamp circuit 220 in the phase to DC converter limits the output 219 of the phase to DC converter. The effect of the high and low end clamp circuit 220 on the phase to DC converter is graphically shown in the FIG. 4*c*. It will be seen that the high and low clamp circuit 220 clamps the upper and lower ends of the otherwise linear signal 219 at levels 400 and 401, respectively. Thus, the high and low end clamp circuitry 220 establishes minimum and maximum dimming levels.

A temperature cutoff switch 110 (FIG. 1) is also usually employed. All that has been described thus far is prior art.

Figure 3:
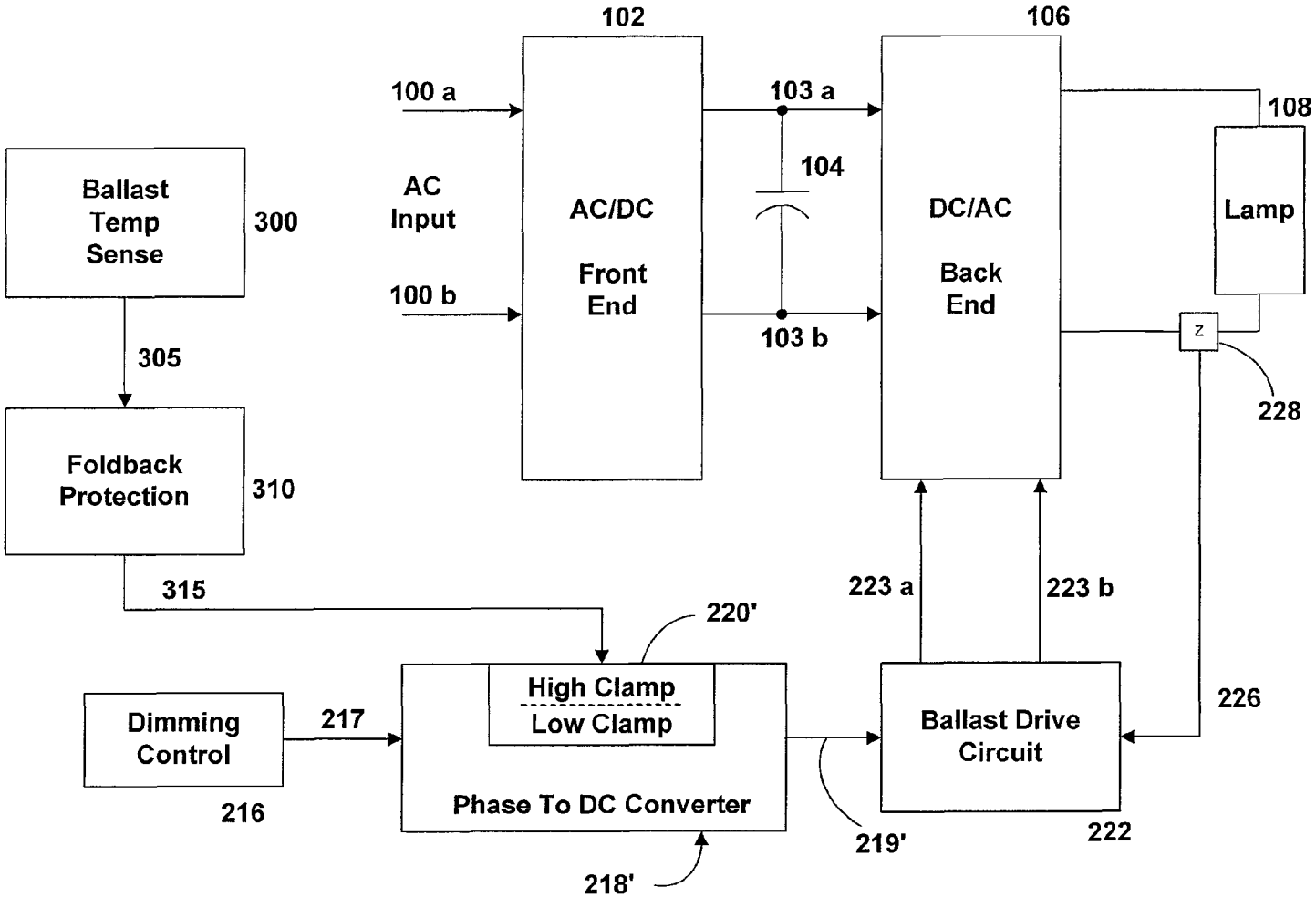
FIG. 3 is a functional block diagram of one embodiment of the present invention as employed in connection with a dimming ballast.

FIG. 3 is a block diagram of a dimming ballast employing the present invention. In particular, the dimming ballast of FIG. 2 is modified to include a ballast temperature sensing circuit 300 that provides a ballast temperature signal 305 to a foldback protection circuit 310. As described below, the foldback protection circuit 310 provides an appropriate adjustment signal 315 to the high and low end clamp circuit 220' to adjust the high cutoff level 400. Functionally, clamp circuit 220' is similar to clamp circuit 220 of FIG. 2, however, the clamp circuit 220' is further responsive to adjustment signal 315, which dynamically adjusts the high end clamp voltage (i.e. level 400).

The ballast temperature sensing circuit 300 may comprise one or more thermistors with a defined resistance to temperature coefficient characteristic, or another type of temperature sensing thermostat device or circuit. Foldback protection circuit 310 generates an adjustment signal 315 in response to comparison of temperature signal 305 to a threshold. The foldback protection circuit may provide either a linear output (using a linear response generator) or a step function output (using a step response generator), or a combination of both, if the comparison determines that an over-temperature condition exists. In principle, the exemplary linear function shown in FIG. 3 may be replaced with any continuous function including linear and non-linear functions. For the purpose of simplicity and clarity, the linear continuous function example will be used. But, it can be appreciated that other continuous functions may equivalently be used. Regardless of the exact function used, the high end clamp level 400 is reduced from its normal operating level when the foldback protection circuit 310 indicates that an over-temperature condition exists. Reducing the high end clamp level 400 adjusts the drive signal 219' to the ballast drive circuit 222 so as to alter the duty cycle, pulse width or frequency of the switching control signals 223*a, b* and hence reduce the output current provided by the ballast to load 108. Reducing output current should, under normal circumstances, reduce the ballast temperature. Any decrease in ballast temperature is reflected in signal 315, and the high end clamp level 400 is increased and/or restored to normal, accordingly.

FIGS. 5*a*-5*d* graphically illustrate various examples of adjusting the output current during an over-temperature condition. These examples are not exhaustive and other functions or combinations of functions may be employed.

Figure 5:
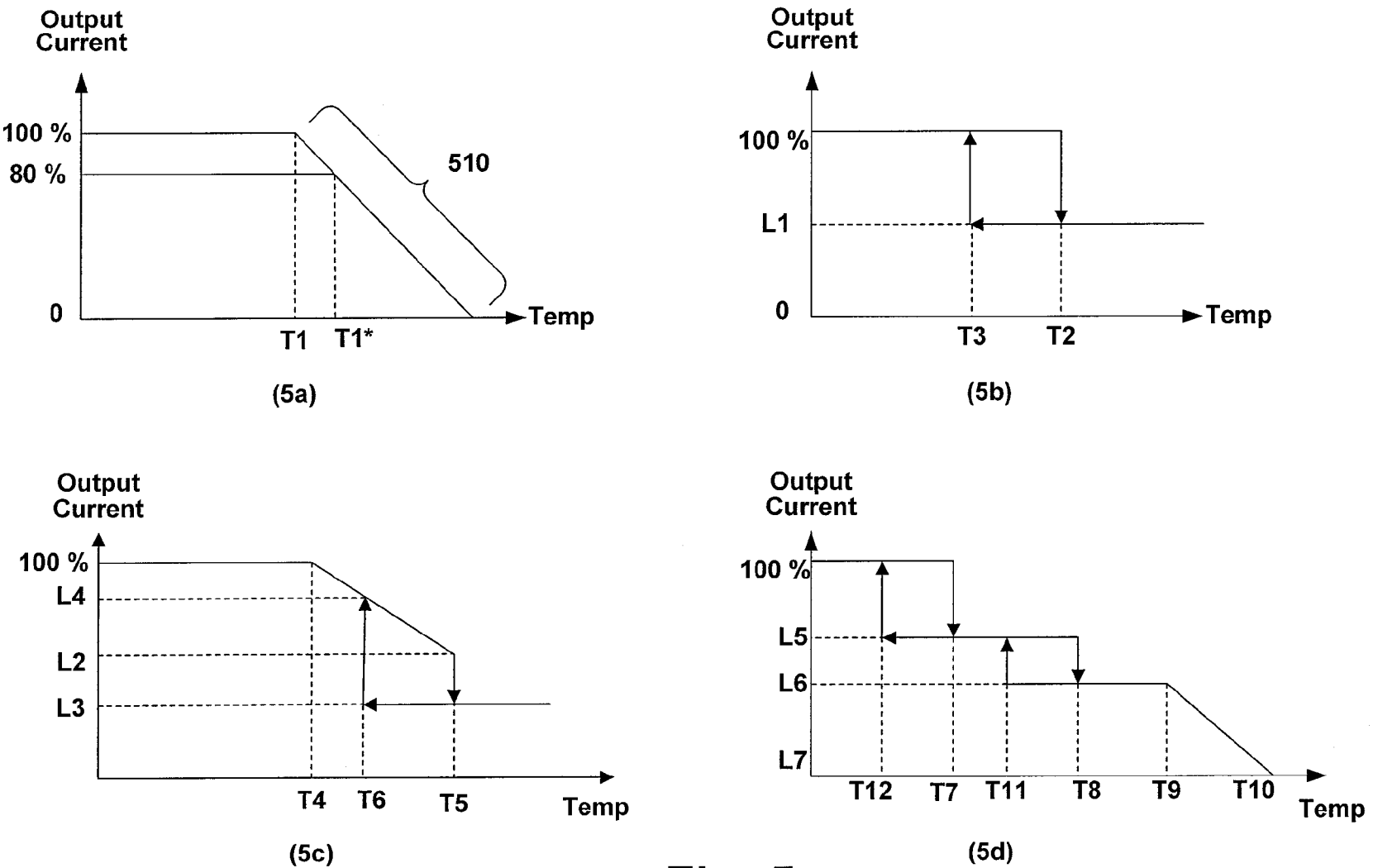
FIG. 5*a* graphically illustrates operation of an embodiment of the present invention to linearly adjust the ballast output current when the ballast temperature is greater than threshold T1.
FIG. 5*b* graphically illustrates operation of an embodiment of the present invention to reduce the ballast output current in a step function to a level L1 when the ballast temperature is greater than threshold T2, and to increase the output current in a step function to 100% when the ballast temperature decreases to a normal temperature T3.
FIG. 5*c* graphically illustrates operation of an embodiment of the present invention to adjust the ballast output current linearly between temperature thresholds T4 and T5, to reduce the ballast output current in a step function from level L2 to level L3 if temperature threshold T5 is reached or exceeded, and to increase the output current in a step function to level L4 when the ballast temperature decreases to threshold T6.
FIG. 5*d* graphically illustrates operation of an embodiment of the present invention to adjust the ballast output current in various steps for various thresholds, and to further adjust ballast output current linearly between levels L6 and L7 if the stepwise reductions in output current are not sufficient to restore the ballast temperature to normal.

In the example of FIG. 5*a*, output current is adjusted linearly when the ballast temperature exceeds threshold T1. If the ballast temperature exceeds T1, the foldback protection circuit 310 provides a limiting input to the high end clamp portion of the clamp circuit 220' so as to linearly reduce the high end clamp level 400, such that the output current may be reduced linearly from 100% to a preselected minimum. The temperature T1 may be preset by selecting the appropriate thresholds in the foldback protection circuit 310 as described in greater detail below. During the over-temperature condition, the output current can be dynamically adjusted in the linear region 510 until the ballast temperature stabilizes and is permitted to be restored to normal. Since fluorescent lamps are often operated in the saturation region of the lamp (where an incremental change in lamp current may not produce a corresponding change in light intensity), the linear adjustment of the output current may be such that the resulting change in intensity is relatively imperceptible to a casual observer. For example, a 40% reduction in output current (when the lamp is saturated) may produce only a 10% reduction in perceived intensity.

The embodiment of the invention of FIG. 3 limits the output current of the load to the linear region 510 even if the output current is less than the maximum (100%) value. For example, referring to FIG. 5*a*, the dimming control signal 217 may be set to operate the lamp load 108 at, for example, 80% of the maximum load current. If the temperature rises to above a temperature value T1, a linear limiting response is not activated until the temperature reaches a value of T1*. At that value, linear current limiting may occur which will limit the output current to the linear region 510. This allows the maximum (100%) linear limiting profile to be utilized even if the original setting of the lamp was less than 100% load current. As the current limiting action of the invention allows the temperature to fall, the lamp load current will once again return to the originally set 80% level as long as the dimmer control signal 217 is unchanged.

In the example of FIG. 5*b*, output current may be reduced in a step function when the ballast temperature exceeds threshold T2. If the ballast temperature exceeds T2, then the foldback protection circuit 310 provides a limiting input to the high end portion of the clamp 220' so as to step down the high end clamp level 400; this results in an immediate step down in supplied output current from 100% to level L1. Once the ballast temperature returns to an acceptable operating temperature T3, the foldback protection circuit 310 allows the output current to immediately return to 100%, again as a step function. Notice that recovery temperature T3 is lower than T2. Thus, the foldback protection circuit 310 exhibits hysteresis. The use of hysteresis helps to prevent oscillation about T2 when the ballast is recovering from a higher temperature. The abrupt changes in output current may result in obvious changes in light intensity so as to alert persons that a problem has been encountered and/or corrected.

In the example of FIG. 5*c*, both linear and step function adjustments in output current are employed. For ballast temperatures between T4 and T5, there is linear adjustment of the output current between 100% and level L2. However, if the ballast temperature exceeds T5, then there is an immediate step down in supplied output current from level L2 to level L3. If the ballast temperature returns to an acceptable operating temperature T6, the foldback protection circuit 310 allows the output current to return to level L4, again as a step function, and the output current is again dynamically adjusted in a linear manner. Notice that recovery temperature T6 is lower than T5. Thus, the foldback protection circuit 310 exhibits hysteresis, again preventing oscillation about T5. The linear adjustment of the output current between 100% and L2 may be such that the resulting change in lamp intensity is relatively imperceptible to a casual observer, whereas the abrupt changes in output current between L2 and L3 may be such that they result in obvious changes in light intensity so as to alert persons that a problem has been encountered and/or corrected.

In the example of FIG. 5*d*, a series of step functions is employed to adjust the output current between temperatures T7 and T8. Particularly, there is a step-wise decrease in output current from 100% to level L5 at T7 and another step-wise decrease in output current from level L5 to level L6 at T8. Upon a temperature decrease and recovery, there is a step-wise increase in output current from level L6 to level L5 at T11, and another step-wise increase in output current from level L5 to 100% at T12 (each step function thus employing hysteresis to prevent oscillation about T7 and T8). Between ballast temperatures of T9 and T10, however, linear adjustment of the output current, between levels L6 and L7, is employed. Once again, step and linear response generators (described below) in the foldback protection circuitry 310 of FIG. 3 allow the setting of thresholds for the various temperature settings. One or more of the step-wise adjustments in output current may result in obvious changes in light intensity, whereas the linear adjustment may be relatively imperceptible.

In each of the examples, a thermal cutout switch may be employed, as illustrated at 110 in FIG. 1, to remove the supply voltage and shut down the ballast if a substantial over-temperature condition is detected.

Figure 6:
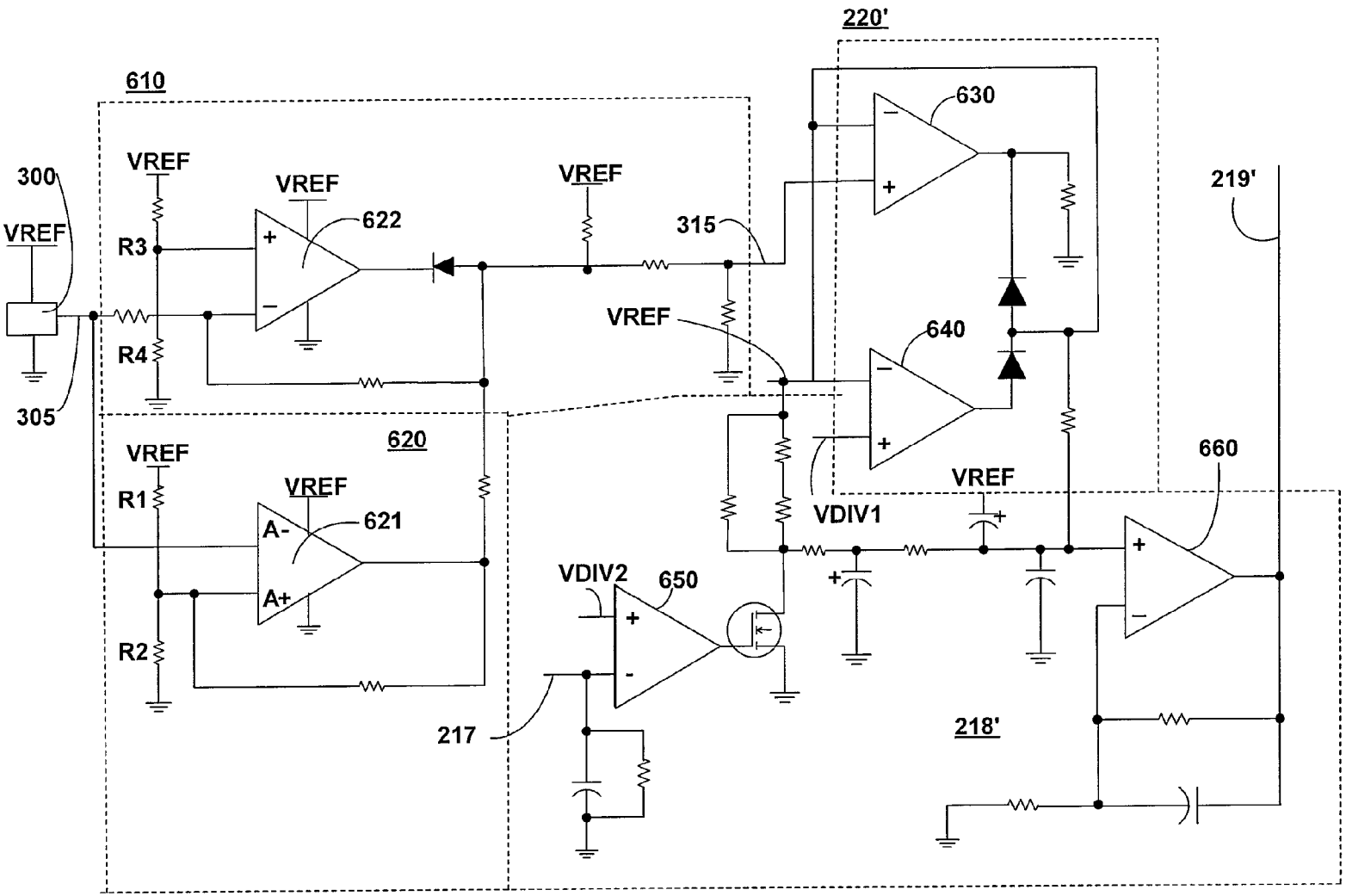
FIG. 6 illustrates one circuit level implementation for the embodiment of FIG. 3 that exhibits the output current characteristics of FIG. 5*c*.

FIG. 6 illustrates one circuit level implementation of selected portions of the FIG. 3 embodiment. The foldback protection circuit 310 includes a linear response generator 610 and a step response generator 620. The adjustment signal 315 drives the output stage 660 of the phase to DC converter 218' via the high end clamp 630 of the clamp circuit 220'. A low end clamp 640 is also shown.

Temperature sensing circuit 300 may be an integrated circuit device that exhibits an increasing voltage output with increasing temperature. The temperature sensing circuit 300 feeds the linear response generator 610 and the step response generator 620. The step response generator 620 is in parallel with the linear response generator 610 and both act in a temperature dependent manner to produce the adjustment signal 315.

The temperature threshold of the linear response generator 610 is set by voltage divider R3, R4, and the temperature threshold of the step response generator 620 is set by voltage divider R1, R2. The hysteresis characteristic of the step response generator 620 is achieved by means of feedback, as is well known in the art.

The threshold of low end clamp 640 is set via a voltage divider labeled simply VDIV1. The phase controlled dimming signal 217 is provided to one input of a comparator 650. The other input of comparator 650 receives a voltage from a voltage divider labeled VDIV2. The output stage 660 of the phase to DC converter 218' provides the control signal 219'.

Those skilled in the art will appreciate that the temperature thresholds of the linear and step response generators 610, 620 may be set such that the foldback protection circuit 310 exhibits either a linear function followed by a step function (See FIG. 5*c*), or the reverse. Sequential step functions may be achieved by utilizing two step response generators 620 (See steps L5 and L6 of FIG. 5*d*). Likewise, sequential linear responses may be achieved by replacing the step response generator 620 with another linear response generator 610. If only a linear function (FIG. 5*a*) or only a step function (FIG. 5*b*) is desired, only the appropriate response generator is employed. The foldback protection circuit 310 may be designed to produce more than two types of functions, e.g., with the addition of another parallel stage. For example the function of FIG. 5*d* may be obtained with the introduction of another step response generator 620 to the foldback protection circuit, and by setting the proper temperature thresholds.

Figure 7:
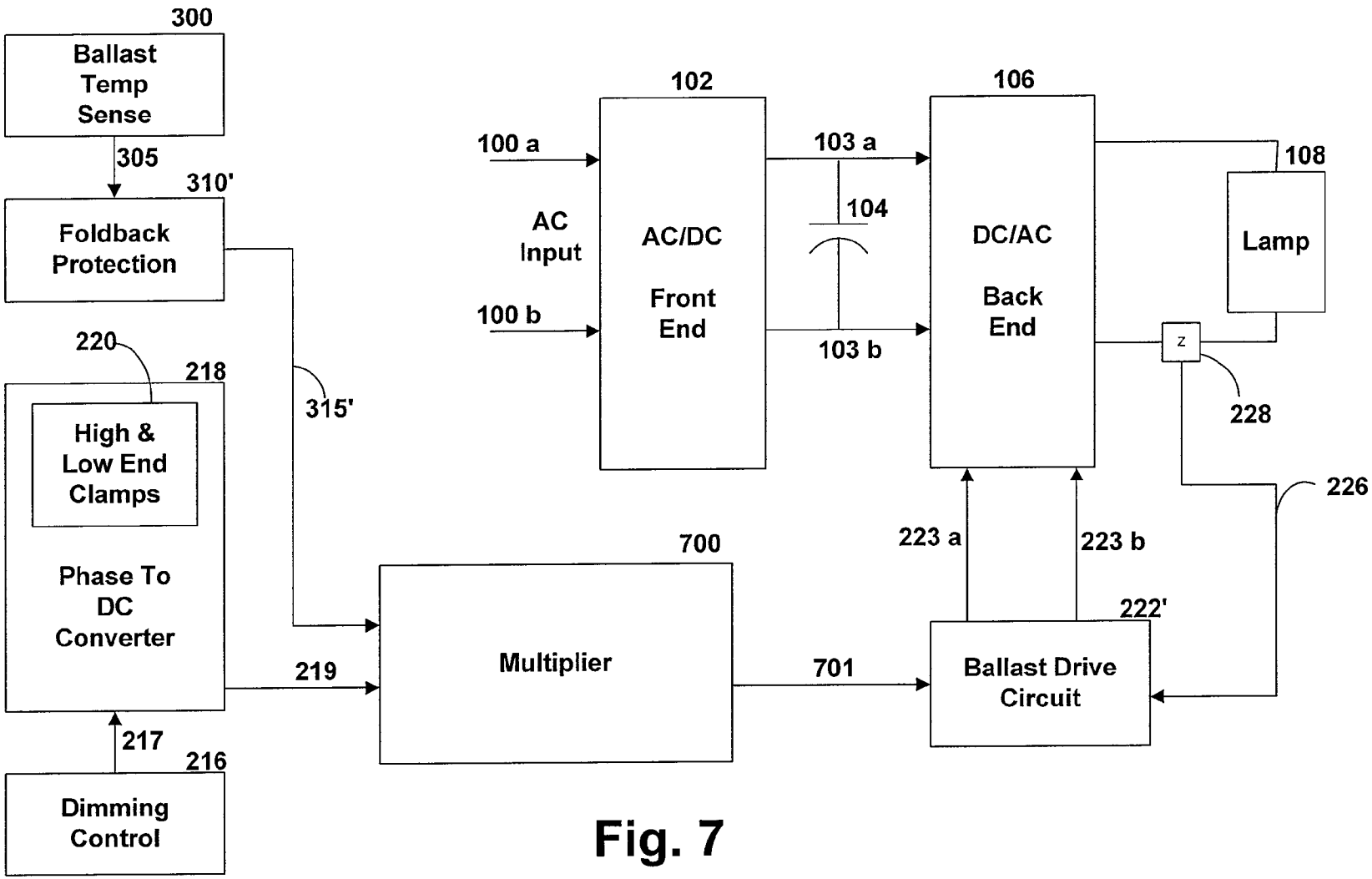
FIG. 7 is a functional block diagram of another embodiment of the present invention for use in connection with a dimming ballast.

FIG. 7 is a block diagram of a dimming ballast according to another embodiment of the invention. Again, the dimming ballast of FIG. 2 is modified to include a ballast temperature sensing circuit 300 that provides a ballast temperature signal 305 to a foldback protection circuit 310. The foldback protection circuit 310' produces, as before, an adjustment signal 315' to modify the response of the DC to AC back end 106 in an over-temperature condition. Nominally, the phase controlled dimming signal 217 from the dimming control 216, and the output of the high and low end clamps 220, act to produce the control signal 219 that is used, for example, in the dimming ballast of FIG. 2. However, in the configuration of FIG. 7, the control signal 219 and the adjustment signal 315' are combined via multiplier 700. The resulting product signal 701 is used to drive the ballast drive circuit 222' in conjunction with feedback signal 226. It should be noted that ballast drive circuit 222' performs the same function as the ballast drive circuit 222 of FIG. 3 except that ballast drive circuit 222' may have a differently scaled input as described hereinbelow.

As before, in normal operation, dimming control 216 acts to deliver a phase controlled dimming signal 217 to the phase to DC converter 218. The phase to DC converter 218 provides an input 219 to the multiplier 700. The other multiplier input is the adjustment signal 315'.

Under normal temperature conditions, the multiplier 700 is influenced only by the signal 219 because the adjustment signal 315' is scaled to represent a multiplier of 1.0. Functionally, adjustment signal 315' is similar to 315 of FIG. 3 except for the effect of scaling. Under over-temperature conditions, the foldback protection circuit 310' scales the adjustment signal 315' to represent a multiplier of less than 1.0. The product of the multiplication of the signal 219 and the adjustment signal 315' will therefore be less than 1.0 and will thus scale back the drive signal 701, thus decreasing the output current to load 108.

Figure 8:
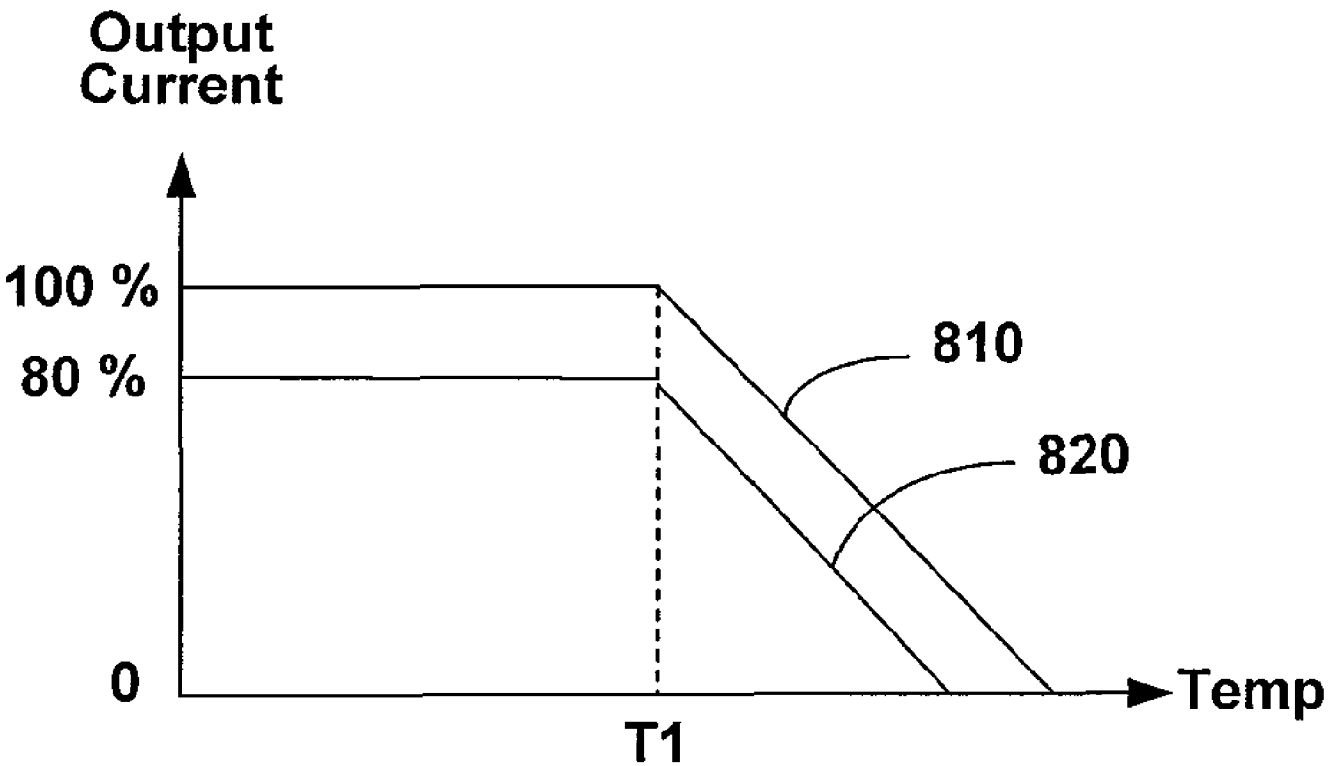
FIG. 8 is an output current versus temperature response for the embodiment of FIG. 7.

FIG. 8 illustrates the response of output current versus temperature for the embodiment of FIG. 7. As in the response shown in FIG. 5*a*, at 100% of load current, the current limiting function may be linearly decreasing beyond a temperature T1. However, in contrast to FIG. 5*a*, the response of the embodiment of FIG. 7 at lower initial current settings is more immediate. In the multiplier embodiment of FIG. 7, current limiting begins once the threshold temperature of T1 is reached. For example, the operating current of the lamp 108 may be set to be at a level lower than maximum, say at 80%, via dimmer control signal 217 which results in an input signal 219 to multiplier 700. Assuming that the temperature rises to a level of T1, the multiplier input signal 315' would immediately begin to decrease to a level below 1.0 thus producing a reduced output for the drive signal 701. Therefore, the 100% current limiting response profile 810 is different from the 80% current limiting response profile 820 beyond threshold temperature T1.

It can be appreciated by one of skill in the art that the multiplier 700 may be implemented as either an analog or a digital multiplier. Accordingly, the drive signals for the multiplier input would be correspondingly analog or digital in nature to accommodate the type of multiplier 700 utilized.

Figure 9:
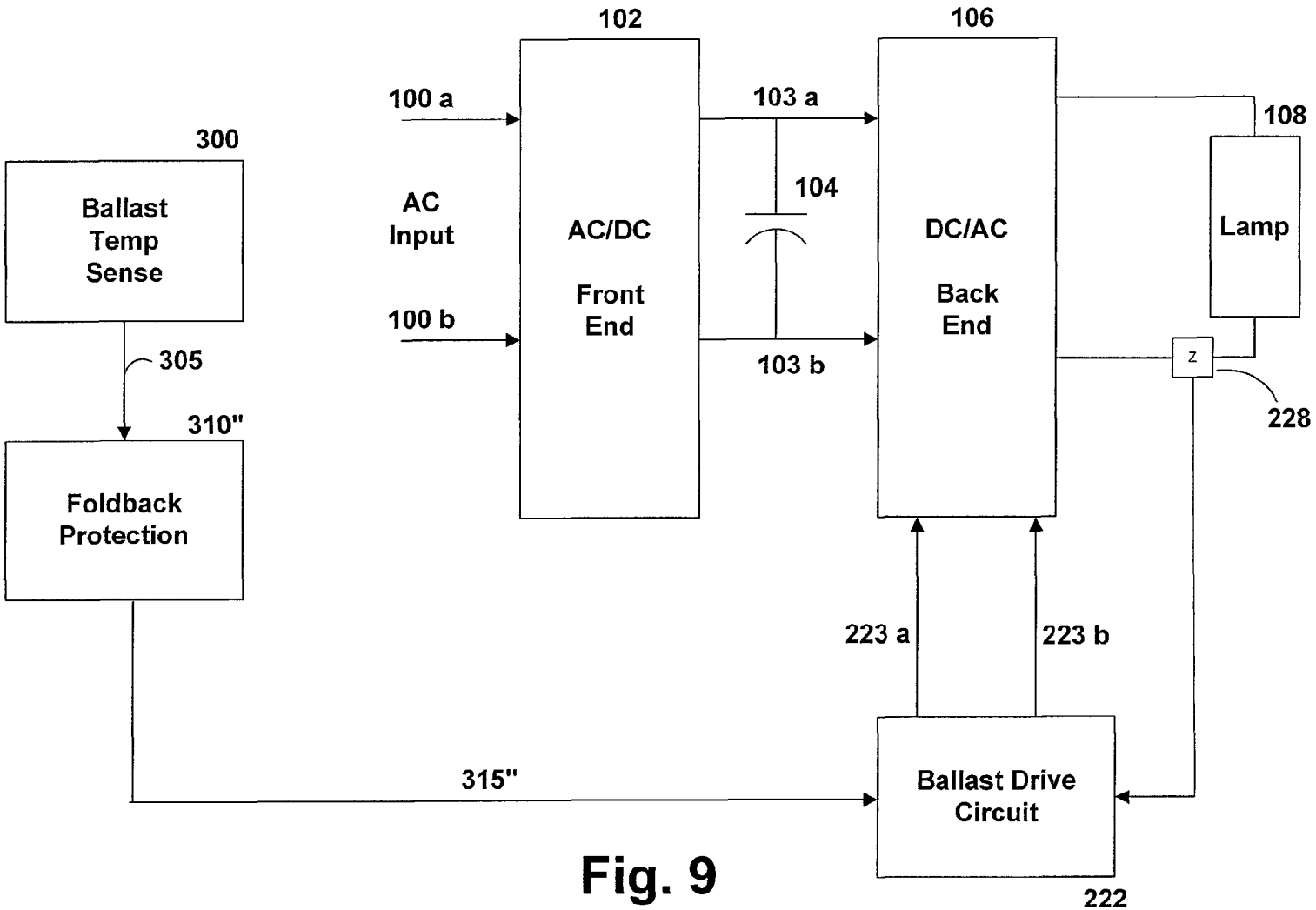
FIG. 9 is a functional block diagram of an embodiment of the present invention that may be employed with a non-dimming ballast.

FIG. 9 illustrates application of the invention to a non-dimming ballast, e.g., of the type of FIG. 2, which does not employ high end and low end clamp circuitry or a phase to DC converter. As before, there is provided a ballast temperature sensing circuit 300 that provides a ballast temperature signal 305 to a foldback protection circuit 310". The foldback protection circuit 310' provides an adjustment signal 315" to ballast drive circuit 222. Instead of adjusting the level of a high end clamp, the adjustment signal 315" is provided directly to ballast drive circuit 222. Otherwise the foregoing description of the function and operation of FIG. 3, and the examples of FIGS. 5*a*-5*d*, are applicable.

Figure 10:
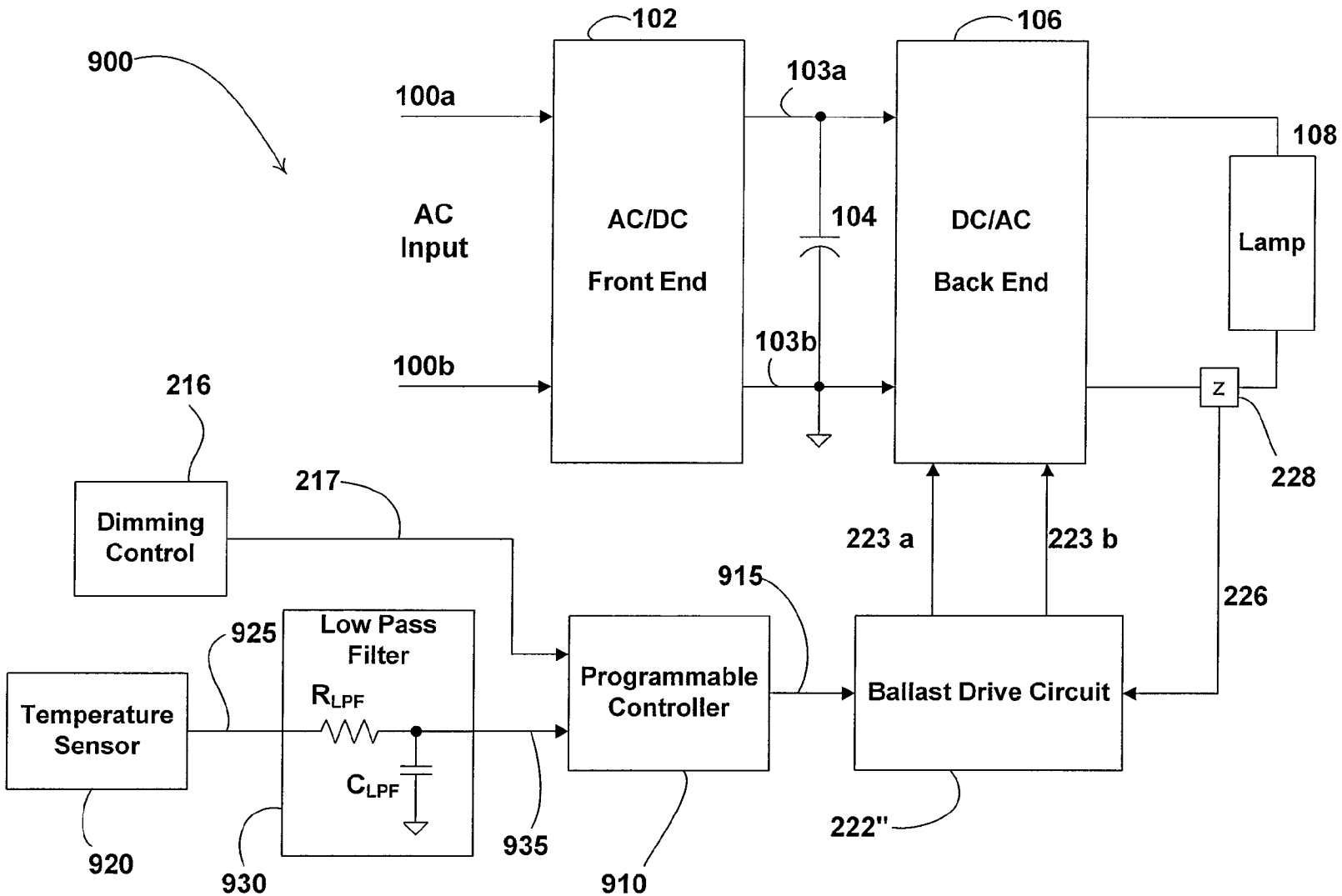
FIG. 10 is a simplified block diagram of an electronic dimming ballast according to another embodiment of the present invention.

FIG. 10 is a simplified block diagram of an electronic dimming ballast 900 according to another embodiment of the present invention. The ballast 900 comprises a programmable controller 910, which controls a ballast drive circuit 222" via a pulse-width modulated (PWM) type signal 915. The input to the programmable controller is via the analog inputs provided by the dimming control 216 and the temperature sensor 920. Alternatively, the input provided by the dimming control 216 may comprise a digital control signal received via a digital communication link, e.g., a digital addressable lighting interface (DALI) communication link.

The programmable controller 910 may be any suitable digital controller mechanism such as a microprocessor, microcontroller, programmable logic device (PLD), or an application specific integrated circuit (ASIC). In one embodiment, the programmable controller 910 includes a microcontroller device that incorporates at least one analog-to-digital converter (ADC) for the analog inputs and at least one digitally controllable output driver suitable for use as a pulse-width modulator. In another embodiment, the programmable controller 910 includes a microprocessor that communicates with a separate ADC and a digitally controlled output driver to act as the pulse-width modulator under program control. It is understood by those of skill in the art that any combination of microcontroller, microprocessor, separate ADC, digital output, PWM, ASIC, and PLD is suitable to implement the programmable controller 910. The programmable controller operates the input and output interfaces via software control for greater flexibility and control than hardware alone. Thus, multiple embodiments of a software control program are possible as is well understood by those of skill in the art.

The programmable controller 910 receives the dimming signal 217 from the dimming control 216 directly and controls the frequency and the duty cycle of the PWM type output signal 915 in response to the dimming signal 217. The ballast drive circuit 222" performs the same function as the ballast drive circuit 222 of FIG. 3. However, the ballast drive circuit 222" controls the switching signals 223*a*, 223*b* in response to the frequency and the duty cycle of the PWM signal 915 rather than in response to the level of the DC voltage signal 219' of FIG. 3.

In normal operation, a software high end clamp value is set in the programmable controller that provides a limit on the maximum value of current that can drive the lamp. The programmable controller 910 is responsive to the dimming control 216 to effectively adjust the current in the lamp 108. The dimming signal is followed until some temperature is reached that would necessitate a reduction of the high end clamp current value for the lamp 108. Thus, the programmable controller 910 normally responds to the dimming control signal 217 until, in an elevated temperature condition, a software high end clamp setpoint is adjusted by the software program. The high end clamp current value adjustment is made so that a maximum predetermined current limit is not exceeded if the dimming control requests a current level that is above a predetermined value for a specific temperature. If an elevated temperature condition is present, but the dimming control is set to a value that would result in a current level that is below the high end clamp value, then the value of the dimming control signal would still control the lamp current. Otherwise, in an elevated temperature condition, where the dimming control would result in a high current value at the lamp, the programming of the digital controller 910 effectively lowers the software high end clamp to keep the lamp operating at a predetermined current level.

Referring back to FIG. 10, the ballast 900 further comprises a temperature sensor 920, which is thermally coupled to the ballast. In one embodiment, the temperature sensor 920 may be an integrated circuit (IC) sensor, such as, for example, model number FM50 manufactured by Fairchild Semiconductor. The temperature sensor 920 generates a DC temperature signal 925, which has a magnitude that varies linearly in response to the temperature of the ballast 900. As a specific example, the magnitude $V_{TEMP}$ of the temperature signal 925 at the output of the FM50 temperature sensor may be defined by:

$$V_{TEMP}=500+10\cdot T_{FM50}\,(\text{mV}), \qquad \text{(Equation 1)}$$

where $T_{FM50}$ is the temperature of the FM50 temperature sensor in degrees Celsius (° C.), which represents the present temperature of the ballast 900. A different relationship between output voltage and temperature may exist if a different temperature sensor is used.

The temperature signal 925 is filtered by a hardware low pass filter 930 to produce a filtered temperature signal 935. The low pass filter 930 may be a resistor-capacitor (RC) circuit comprising a resistor $R_{LPF}$ and a capacitor $C_{LPF}$ as shown in FIG. 10. Preferably, the resistor $R_{LPF}$ has a resistance of 6.49 kΩ and the capacitor $C_{LPF}$ has a capacitance of 0.22 μF, such that the low pass filter 930 has a cutoff frequency of 700.4 radians/sec (i.e., 111.5 Hz). Other configurations of low pass filter 930 may be used in place of the RC configuration shown in FIG. 10. The filtered temperature signal 935 is provided to an analog to-digital converter (ADC) input of the programmable controller 910. Accordingly, the programmable controller 910 is operable to control the ballast drive circuit 222" and thus the intensity of the lamp 108 in response to the temperature of the ballast 900 and the dimming control signal 217.

Figure 11:
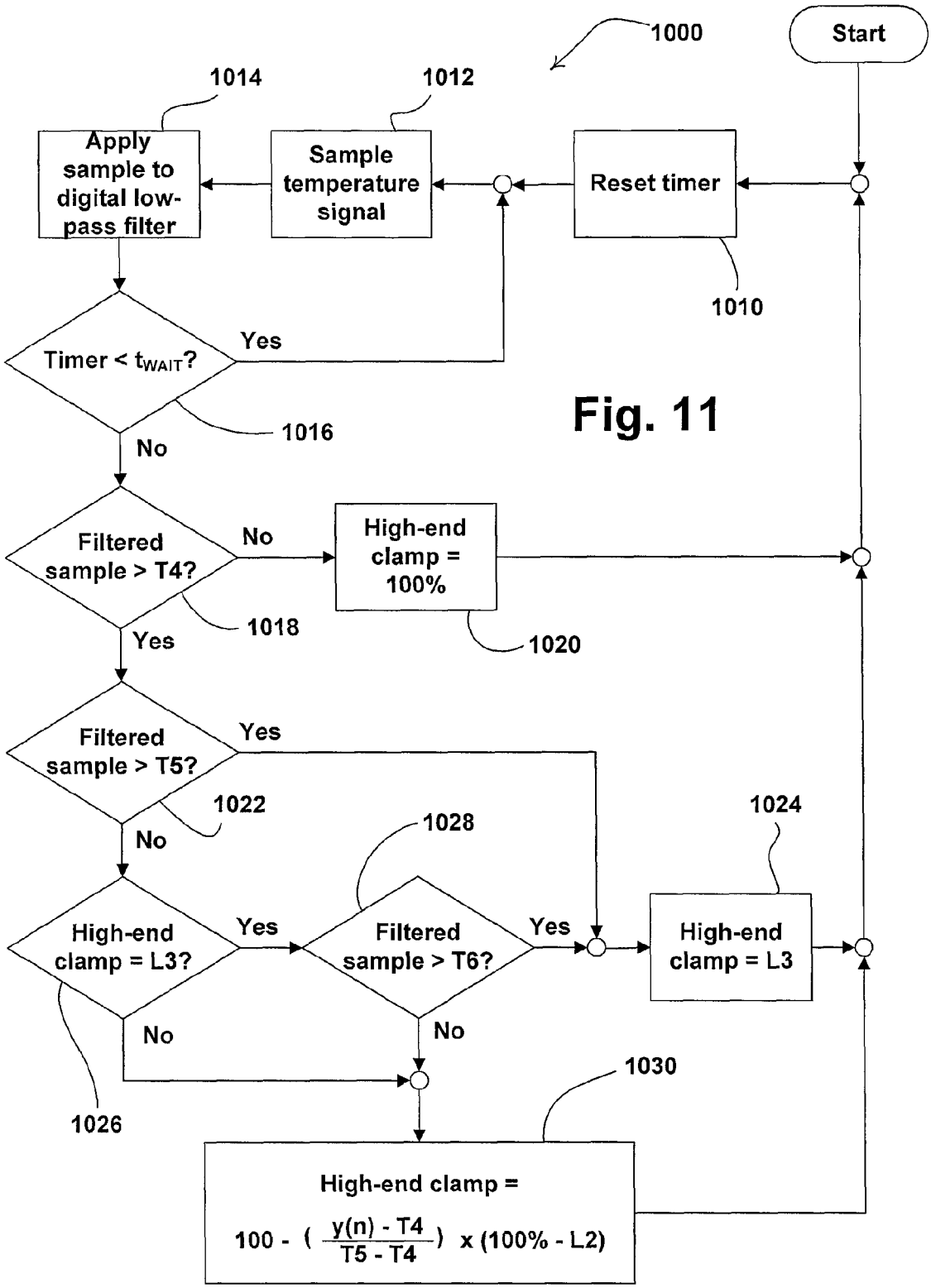
FIG. 11 is a flowchart of a thermal foldback protection procedure executed by a programmable controller of the ballast of FIG. 10 according to the present invention.

FIG. 11 is a flowchart of a thermal foldback protection procedure 1000 executed by the programmable controller 910 according to the present invention. In the example embodiment shown in FIG. 11, the programmable controller 910 controls the output current of the ballast 900 in response to the temperature according to the control scheme illustrated in FIG. 5*c* which includes both a continuous function and a step function response versus temperature. However, the programmable controller 910 could control the output current in accordance with any of the control schemes shown in FIGS. 5*a*-5*d*, or another control scheme not shown. This flexibility of programming and adaptability of operation of a programmable controller is easily recognized by one of skill in the art. Thus, any one of the FIGS. 5*a*-5*d* control schemes or any combination thereof may be implemented for ballast control using the programmable controller 910. In the implementation of FIG. 5*c* using the programmable controller 910, the output current of the ballast 900 is achieved by adjusting the software high end clamp which defines the maximum allowed level of the output current. Adjustment of the software high end clamp provides the programmable controller the flexibility to accommodate the maximum current value for any temperature versus current profile that is selected for the ballast.

Referring to FIG. 11, a timer is first reset to zero at step 1010 and begins increasing in value. At step 1012, the filtered temperature signal 935 at the ADC input of the programmable controller 910 is sampled. The sample is then applied to a software implemented digital low-pass filter at step 1014 to smooth out ripple in the filtered temperature signal 935. In one embodiment, the digital low-pass filter is a first order recursive filter defined by $$y(n)=a0\cdot x(n)+b1\cdot y(n-1), \quad \text{(Equation 2)}$$

where x(n) is the present sample of the filtered temperature signals 935 from step 1012, y(n−1) is the previous filtered sample, and y(n) is the present filtered sample, i.e., the present output of the digital low-pass filter. In one embodiment, the constants a0 and b1 have values of 0.01 and 0.99, respectively.

If the timer has not reached a predetermined time $t_{WAIT}$ at step 1016, the process loops to sample and filter once again. In one embodiment, steps 1012 and 1014 are executed once every 2.5 msec. Each of the 2.5 msec samples is applied to the filter and processed before the next sample is taken. When the timer has exceeded the predetermined time $t_{WAIT}$ at step 1016, the output current of the ballast 900 is controlled in response to the filtered sample as described below. In one embodiment, the predetermined time $t_{WAIT}$ is one second, such that the programmable controller 910 does not adjust the output current too quickly in response to the temperature. If the output current is controlled too quickly in response to the temperature of the ballast, noise in the filtered temperature signal 935 could cause the lamp 108 to flicker. The application of multiple samples of the temperature sensor to the digital low pass filter effectively controls flicker by filtering out noise in the temperature samples.

If the filtered sample is not greater than the temperature T4, as shown in FIG. 5*c*, at step 1018, the high end clamp software setpoint is set to 100% at step 1020. That is, the ballast 900 is allowed to control the intensity of the lamp 108 to the maximum possible level in response to the dimming control 216 input to the programmable controller. Next, the process loops to reset the timer at step 1010.

If the filtered sample is greater than the temperature T4 at step 1018, a determination is made as to whether the filtered sample is greater than the temperature T5 (FIG. 5*c*) at step 1022. If so, the high end software setpoint clamp is set to the level L3 (FIG. 5*c*) at step 1024, such that the maximum possible intensity of the lamp 108 is limited to the level L3, and then the process loops back to step 1010. Otherwise, the process moves to step 1026.

If the high end setpoint clamp is equal to the level L3 at step 1026, a determination is made as to whether the filtered sample is greater than the temperature T6 (FIG. 5*c*) at step 1028. If so, the high end clamp is set to the level L3 at step 1024 and the process loops to step 1010. If the high end clamp is not equal to the level L3 at step 1026, or if the filtered sample is not greater than the temperature T6 at step 1028, the high end clamp is set to a point P on the linear region between T4 and T5 at step 1030, where $$P=100\%-(y(n)-T4)/(T5-T4)\cdot(100\%-L2). \quad \text{(Equation 3)}$$

Next, the process loops back around to step 1010.

As noted above, if the dimmer control 216 is requesting a lamp intensity level that requires a lamp current that is less than the software high end clamp level, then the programmable controller is responsive to the dimmer control 216 and the corresponding signal 217. If the dimmer control 216 is set to request a lamp intensity level that corresponds to a lamp current in excess of the software high end clamp current level, then the programmable controller 910 effectively limits the lamp current level to the calculated high end clamp current value.

The method of FIG. 11 may be useful to stabilize the temperature in an overheated ballast while keeping the ballast in operation. Referring to FIG. 5*c*, by lowering the high end current via the software setpoint clamp at steps 1030 or 1024, a ballast that has a temperature over T4 will dissipate less power giving the ballast an opportunity to cool. After the lamp reaches a temperature below T4 at step 1018, the ballast may once again return to full power via a setpoint change to 100% at step 1020, which restores non-current limiting operation and corresponding full range use of the dimmer control.

In an alternative embodiment, the configuration of FIG. 10 may be constructed without a dimming control 216. In this instance, a non-dimming ballast design results that has a programmable controller 910 to maintain the lamp current at a fixed level and to adjust for operation at different temperatures. The high end clamping current value adjustment for elevated temperature operation as described in the flow diagram of FIG. 11 is applicable as an example using the profile of FIG. 5*c* as described above. Other current-versus-temperature profiles, such as any of FIGS. 5*a*-5*d* or any combination therein are possible using the programmable aspect of the temperature compensation technique.

The circuitry described herein for implementing the invention is preferably packaged with, or encapsulated within, the ballast itself, although such circuitry could be separately packaged from, or remote from, the ballast.

It will be apparent to those skilled in the art that various modifications and variations may be made in the apparatus and method of the present invention without departing from the spirit or scope of the invention. For example, although a linearly decreasing function is disclosed as one possible embodiment for implementation of current limiting, other continuously decreasing functions, even non-linear decreasing functions, may be used as a current limiting mechanism without departing from the spirit of the invention. Thus, it is intended that the present invention encompass modifications and variations of this invention provided those modifications and variations come within the scope of the appended claims and equivalents thereof.

What is claimed is:

1. A circuit for controlling output current from a ballast to a lamp comprising:

a) a temperature sensor thermally coupled to the ballast to provide a temperature signal having a magnitude indicative of ballast temperature, Tb; and b) a programmable controller operable to cause the ballast to enter a current limiting mode when the magnitude of the temperature signal indicates that Tb has exceeded a predetermined ballast temperature, Ti;

wherein the programmable controller causes the output current to be responsive to the temperature signal according to one of (i) a step function or (ii) a combination of step and continuous functions, while continuing to operate the ballast, wherein the programmable controller comprises:

a processor for executing a software program to receive a dimmer control signal and the temperature signal and to output a pulse width modulated digital output signal;

wherein a digital filter and a wait time are applied in the processor for limiting flicker in the lamp; and at least one analog-to-digital converter for sampling the temperature signal.

2. A circuit according to claim 1, wherein the programmable controller comprises one of a microcontroller, a microprocessor, a programmable logic device, and an application specific integrated circuit.

3. A circuit according to claim 1, including:

a low-pass filter operable to receive the temperature signal and to provide a filtered temperature signal to the programmable controller.

4. A circuit according to claim 3, wherein the low-pass filter comprises a resistor and a capacitor.

5. A circuit according to claim 1, including:

a ballast drive circuit responsive to a pulse-width modulated signal from the programmable controller, the pulse-width modulated signal resulting in a lamp current corresponding to a current level set by a dimmer control signal or a software high end clamp value.

6. A circuit according to claim 1, wherein the software program comprises:

instructions for processing multiple consecutive samples of the temperature signal; and instructions for calculating a software high end clamp value to limit a current to the lamp.

7. A circuit according to claim 6, wherein the instructions for processing multiple consecutive samples of the temperature signal comprise a recursive digital filter.

8. A circuit according to claim 1, wherein the programmable controller reduces the maximum permissible output current in response to the temperature signal.

9. A thermally protected ballast comprising:

a) a front end AC-to-DC converter for receiving a supply voltage;

b) a back end DC-to-AC converter coupled to the front end AC-to-DC converter for providing output current to a load;

c) a temperature sensor adapted to provide a temperature signal having a magnitude indicative of a temperature of the ballast, Tb; and d) a programmable controller responsive to the temperature signal and operable to cause the DC-to-AC converter to adjust the output current;

wherein the temperature signal causes the programmable controller to adjust the output current in response to a detected over-temperature condition, according to one of (i) a step function or (ii) a combination of step and linear functions, while continuing to operate the ballast, wherein the programmable controller comprises:

a processor executing instructions to process a dimmer control signal and the temperature signal to control the output current, wherein a digital filter and a wait time are applied in the processor for limiting flicker in the lamp; and wherein the processor is responsive to the dimmer control signal to operate at a first current level until a temperature is reached having a corresponding lower current level, wherein a reduction to the lower current level is asserted.

10. A thermally protected ballast according to claim 9, including:

a hardware low-pass filter operable to receive the temperature signal and to provide a filtered temperature signal to the programmable controller.

11. A thermally protected ballast according to claim 9, wherein the instructions executed by the processor comprise a recursive digital filter for filtering information from the temperature sensor.

12. A method of controlling a ballast comprising the steps of:

a) determining a temperature Tb of the ballast, wherein determining the temperature Tb of the ballast comprises:

receiving, by a programmable controller comprising a processor, a temperature signal having a magnitude indicative of ballast temperature Tb and applying a digital filter and a wait time in the processor for limiting flicker in the lamp; and b) comparing the temperature Tb to a first reference temperature TI; and c) controlling an output current provided by the ballast according to one of (i) a step function or (ii) a combination of a step and continuous functions, while continuing to operate the ballast, in accordance with the result of step (b);

d) acquiring a dimmer control signal representative of a desired lamp illumination level, the dimmer control signal acquired using the programmable controller which is responsive to the dimmer control signal to operate the ballast at a first current level until the temperature signal indicates an elevated ballast temperature; and c) upon determination of an elevated ballast temperature, reducing the output current according to a temperature-versus-current profile of the programmable controller.

13. A method according to claim 12, including the step of:

acquiring a temperature signal representative of the temperature Tb of the ballast.

14. A method according to claim 13, wherein acquiring the temperature signal comprises sampling the temperature signal using a hardware low pass filter.

15. A method according to claim 13, wherein the step of controlling an output current comprises:

acquiring multiple samples of the temperature Tb with an analog-to-digital converter;

applying the samples to a digital filter;

determining if the digital filter output exceeds the first temperature TI;

if the digital filter output exceeds the first temperature T1, calculating a high end current value corresponding to operation of the ballast at the temperature Ti, wherein the calculation is one of (i) a step function or (ii) a combination of a step and continuous functions; and adjusting the output current to correspond to the calculated high end current value.

16. A method according to claim 13, including the step of:

comparing the temperature Tb to a second reference temperature T2 greater than the first reference temperature Ti;

wherein the step of controlling an output current further comprises the steps of:

controlling the output current provided by the ballast linearly with respect to the temperature Tb when the temperature Tb is between the first reference temperature Ti and the second reference temperature T2; and controlling the output current provided by the ballast in accordance with a step function when the temperature Tb is greater than second reference temperature T2.

17. A method according to claim 13, including the steps of:

comparing the temperature Tb to a second reference temperature T2, greater than the first reference temperature Ti; and comparing the temperature Tb to a third reference temperature T3, greater than the first reference temperature Ti and less than the second reference temperature T2;

wherein step of controlling an output current further comprises the steps of:

controlling the output current provided by the ballast linearly with respect to the temperature Tb when the temperature Tb is between the first reference temperature T1 and the second reference temperature T2;

controlling the output current provided by the ballast in accordance with a step function to a first magnitude when the temperature Tb is greater than the second reference temperature T2; and subsequently controlling the output current provided by the ballast in accordance with a step function to a second magnitude greater than the first magnitude, when the temperature Tb is less than the third reference temperature T3.

* * * * *